US005127864A

United States Patent [19]

Fleming

[11] Patent Number: 5,127,864

[45] Date of Patent: Jul. 7, 1992

[54] METHOD OF MAKING A DOUBLE ENDED LAMP

[75] Inventor: Raymond T. Fleming, Lexington, Ky.

[73] Assignee: GTE Products Corporation, Danvers, Mass.

[21] Appl. No.: 673,603

[22] Filed: Mar. 21, 1991

[51] Int. Cl.[5] ..... H01J 9/18; H01J 9/32

[52] U.S. Cl. ..... 445/27; 445/32

[58] Field of Search ..... 445/27, 32

[56] References Cited

U.S. PATENT DOCUMENTS

| | | | |
|---|---|---|---|
| 2,191,346 | 2/1940 | Greiner | 445/32 |
| 3,274,426 | 9/1966 | Scoledge et al. | 313/51 |
| 3,785,019 | 1/1974 | Chiola et al. | 445/27 |
| 4,132,922 | 1/1979 | Newton et al. | 313/315 |

*Primary Examiner*—Kurt Rowan

*Assistant Examiner*—Jeffrey T. Knapp

*Attorney, Agent, or Firm*—William E. Meyer

[57] ABSTRACT

A method of making a double ended lamp having a tubular envelope, a filament, and button contacts at opposite ends of the lamp is disclosed. By first forming a metallurgical bond between the button contacts, and a lead rods, a high quality bond may be formed that does not cause the lead rod to become embrittled. The button contact and lead rod assembly is then, if not already, incorporated into the filament assembly. The filament assembly is then accurately positioned in a tubular envelope and sealed in place. The lamp may then be finished by filling, coating, insulating, and so on in a standard fashion. The button contact as a result is accurately positioned with respect to the envelope, and is unlikely to separate from the lead because of crimp failure, or embrittled rod fracture.

3 Claims, 4 Drawing Sheets

METHOD OF MAKING A DOUBLE ENDED LAMP

TECHNICAL FIELD

The invention relates to electric lamps and particularly to methods of manufacturing electric lamps. More particularly the invention is concerned with the manufacture of a double ended filamentary lamp.

BACKGROUND ART

U.S. Pat. No. 3,001,096 issued to Fredrick A. Mosby, on Sep. 19, 1961 for a Terminal Structure for Double-Ended Lamps shows the general structure of the double ended lamps being manufactured by the applicant.

Normally, as disclosed in the Mosby patent, double ended lamps are assembled by positioning a filament in an envelope, with the lead ends of the filament being held in clamps. The envelope ends are then flame heated and sealed to the sealing foils. The lamp is filled with the proper gases, and tubed off. The lamp is then roughly a glass tube with two lead wires protruding from opposite ends. Contact buttons are then attached to the leads. A ceramic insulator is then cemented in place between the glass or quartz end of the lamp, and around the contact button. The cement fills the region between the contact button and the glass or quartz end of the lamp.

The contact buttons commonly are either crimped or welded to the exposed outer leads of the lamp. Unfortunately, these methods are not always fully successful, and durable. The lead wire to contact button connection may fail, causing internal arcing in the lamp seal region. The arcing breaks down the connection further, causing overheating, or electrical failure. The contact button may also separate from the lamp. Also, the crimp or weld may not be square with the filament, and seal. The button contact is then either realigned, that is bent into position, or cemented in place at an incorrect angle. The misaligned contact buttons do not sit in the contact supports properly, so the lamp, and therefore the filament is misaligned with respect to the lamp housing optics.

Crimping only mechanical bonds the lead and the contact button. The mechanical bond may deteriorate in a long life lamp. For example, the contact button can become loose during repeated thermal cycling of the lamp, causing an intermittent contact. The intermittent contact leads to arcing and destruction of the contact and base assembly. Crimping is used on lamps with current ratings of less than eight amperes or where the contact and lead temperature is expected to be less than about 350 degrees Celius.

For lamps with higher current ratings, or higher expected operating temperatures, the button contacts are welded to the exposed lead ends. Welded button contacts require an extra manufacturing step of cleaning the lead first to achieve an adequate weld. The major problem with welded button contacts, is that the lead may become embrittled by the welding. Weld current may not be applied through the filament, so the weld must be made by contacting the exposed lead end between the quartz and the contact button. This is necessarily a small contact region. The second weld contact is made with the exterior side of the contact button, and does not present a problem. The weld heat causes the lead to recrystalize and be brittle. An embrittled lead is easily fractured, leading the same internal arcing, and arc induced break down as in a crimped contact button.

Both of the old methods of crimping and welding are subject to errors in lead cleaning, trimming, and crimper or welder set-up. There is also a loss of time and material in having to trim the lead after lamp sealing. Applicant has found a different method of manufacture that substantially resolves these problems.

DISCLOSURE OF THE INVENTION

A method of forming a double ended filamentary lamp having press sealed ends, and button contacts may be followed by first forming a filament assembly by metallurgically bonding a button contact to a metal rod to form an end of the filament assembly. The filament assembly is then sealed in a tubular envelope by enclosing at least the filament in the tubular envelope, while leaving the button contact exposed for electrical connection. The lamp may then be finished by sealing a lamp fill in the enclosed lamp volume, and attaching supporting insulation intermediate the tubular envelope and exposed contact button as may be desired.

BEST MODE FOR CARRYING OUT THE INVENTION

Figure 1A:
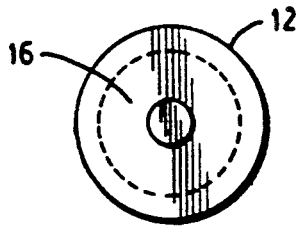
FIG. 1 shows first end (A), side (B) and second end (C) views of a preferred embodiment of a contact button metallurgically bonded to a lead rod.
Figure 1B:
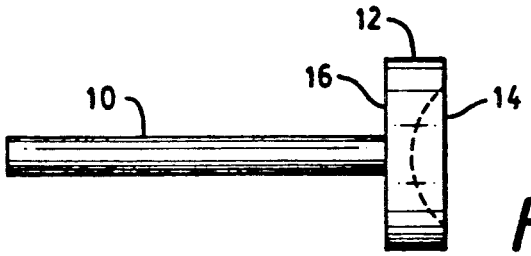
Figure 1C:
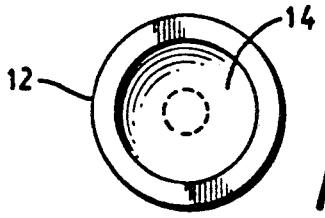

FIG. 1 shows a preferred embodiment of a lead rod metallurgically bonded to a contact button. The first step is to metallurgically bond a lead rod 10 to a contact button 12. The lead rod may be formed from molybdenum. The preferred method is to hold the lead rod 10 in a massive, at least with respect to the lead rod 10, welding clamp. The lead rod 10 is then brought in contact with the contact button 12 held by a second welding clamp. The preferred contact button 12 is a short metal cylinder, having a concave end 14 for exterior contact, and an opposite internal end 16 being flat. In the preferred embodiment, the contact button is made of nickel, but may be made of silver coated nickel, nickel coated steel, or other metal combinations. In an alternative design, formed in the flat side may be a small hole. An end of the lead rod may then be mated in the contact button hole so the lead rod and contact button are correctly aligned.

A welding current is then applied between the welding clamps, causing the lead rod 10 to metallurgically bond to the contact button 12 at the center of the flat end 16. If the flat end 16 is formed without a hole, then the welding location is determined by accurate positioning of the welding clamps. Because the welding clamps are relatively massive, and thermally conductive, the welding heat is quickly passed to the welding clamps, preventing the lead rod 10 from recrystalizing, or otherwise becoming brittle. The lead rod 10 and contact button 12 are then accurately positioned and permanently bonded metallurgically. If necessary, the lead rod and contact button assembly may be heat treated after welding.

Figure 2:
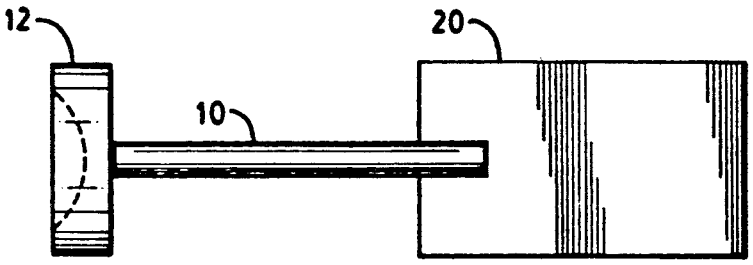
FIG. 2 shows a preferred embodiment of the contact button and lead rod subassembly coupled to a seal foil.

FIG. 2 shows a preferred embodiment of the contact button and lead rod subassembly coupled to a sealing foil 20. The lead rod 10 and contact button 12 assembly is then coupled to a sealing foil 20. Sealing foils are well known in lamp assembly, and the weld connection between the lead rod 10 and sealing foil 20 is ordinary.

Figure 3:
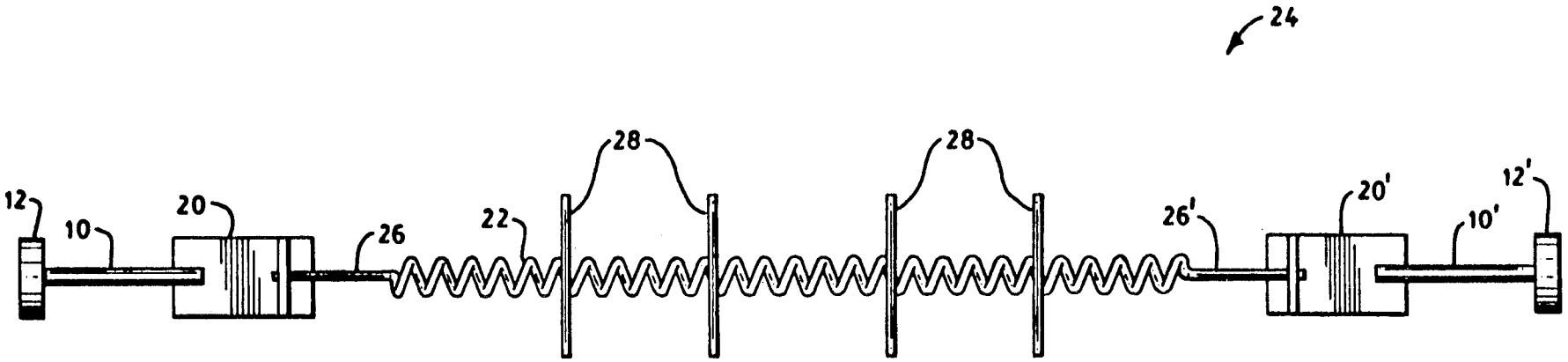
FIG. 3 shows a preferred embodiment of two contact button, lead rod, and seal foil subassemblies coupled to filament to form a filament assembly.

FIG. 3 shows a preferred embodiment of two contact button, lead rod, and sealing foil subassemblies coupled to a filament to form a filament assembly. The next step is to weld the opposite end of the sealing foil 20 to an end of a filament 22 to form a filament assembly 24. The preferred filament 22 is a coil, with straight leg 26 ends. Placed along the filament 22 may be coil positioners 28 to stabilize the filament 22 when in place in the lamp envelope. The preferred filament assembly 24 includes a similar, second lead rod and contact button assembly coupled to the opposite end to the filament 22. The filament assembly 24 then comprises in order, a first contact button 12, first lead rod 10, first sealing foil 20, first filament leg 26, filament 22 (with or without filament positioners 28), second filament leg 26', second sealing foil 20', second lead rod 10' and second contact button 12'.

Figure 4:
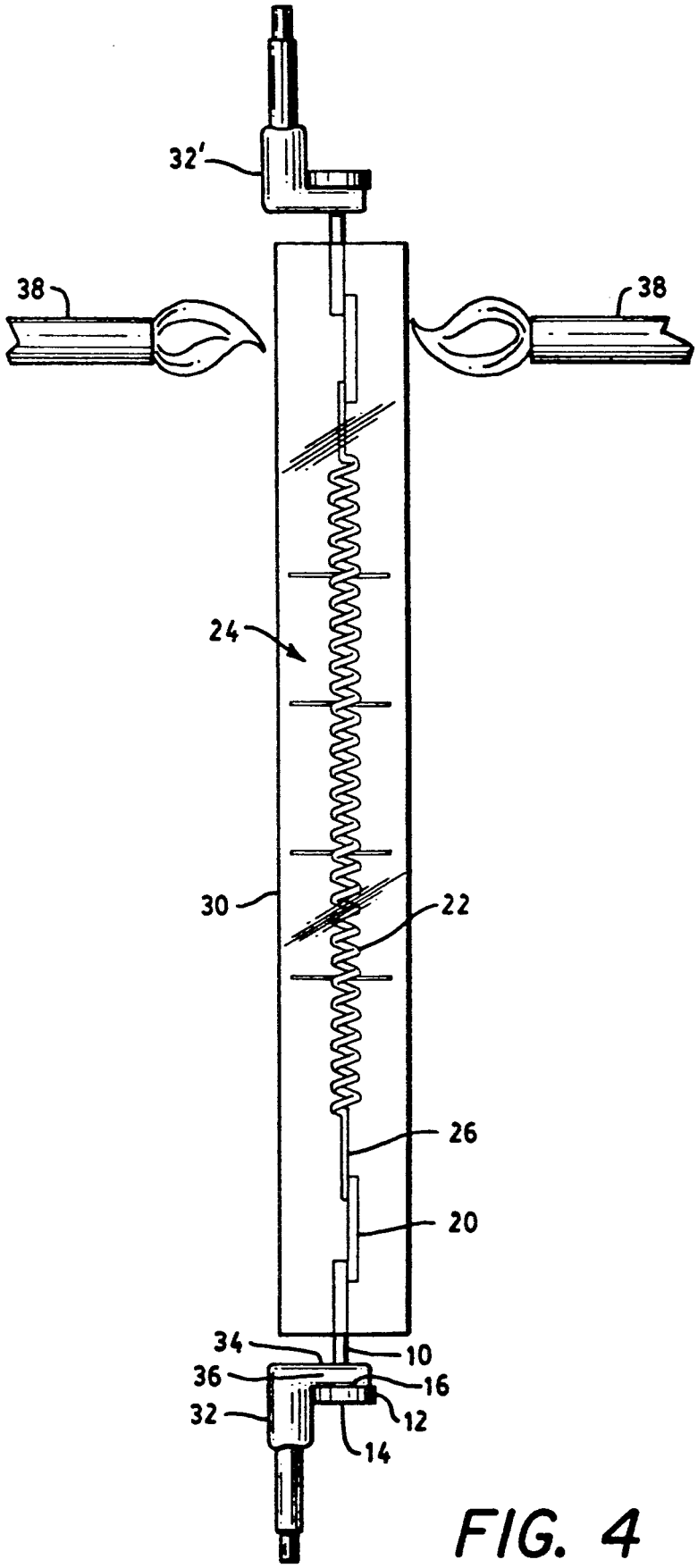
FIG. 4 shows a preferred embodiment of a filament assembly positioned in a tubular envelope prior to press sealing.

FIG. 4 shows a preferred embodiment of a filament assembly positioned in a tubular envelope prior to press sealing. The next step is to position the filament assembly 24 in a glass, or quartz envelope 30. Normally, the in put leads, like lead rods 10, are held in support clamps. Here, the contact buttons 12 are relatively bulky compared to the usual lead wires, and clamping in the usual way may be awkward. The preferred method is to replace the clamps with flat surfaced claws 32. The length of the lead rod 10 is positioned in a claw slot 34, and the flat end 16 of the adjacent contact button 12 abutts a flat face 36 of the claw 32. The lead rod 10 may then be accurately positioned in the claw slot 34, and the contact button 12 may be held square to the filament 22 by the flat claw face 36. A slight tension may be applied to the filament 22. In one example the tension caused about a five percent extension of the filament length. The tension helps abutt the contact button 12 to the claw face 36. Proper alignment and separation of the contact buttons 12 is fixed by the location of the support claws 32. As a result, the contact button to contact button distance, which is the critical distance when the lamp is finally inserted in a socket, is then accurately fixed during the pressing operation, and the exterior button contact faces 14 are correctly angled.

Figure 5:
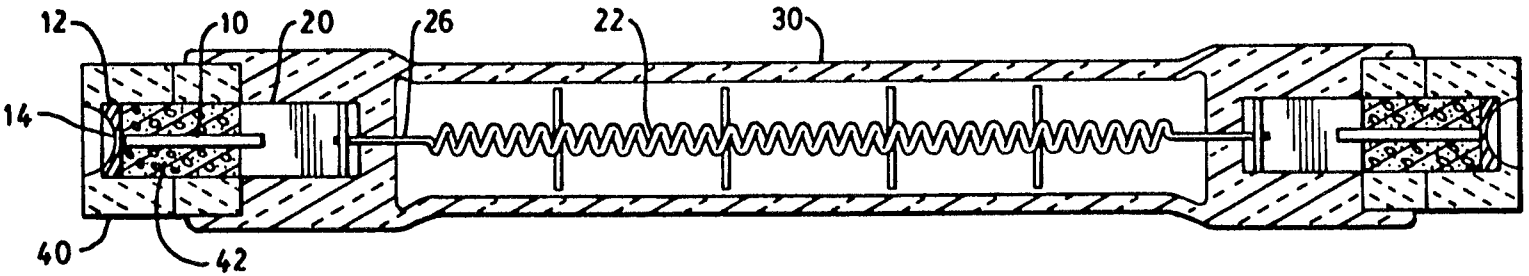
FIG. 5 shows a preferred embodiment completed double ended filament lamp having contact buttons at each end.

The ends of the tubular envelope 30 adjacent the sealing foils 20 are then flame heated 38, and press sealed to the sealing foils 20. The lamp is then normally finished, for example by being tubulated, gas filled, and doped with the materials familiar in the construction of tungsten halogen lamps. The lamp may be coated with reflective, or filtering coatings, if desired. An insulating end is then attached to protect the location of the contact button 12. In the preferred embodiment, a ceramic tube 40 with a slotted end is cemented to the press seal of the glass or quartz tube. Cement 42 fills the region intermediate the glass or quartz, the contact button 12, and the slotted ceramic tube 40. The ceramic tube 34 abutts the diameter of the contact button 12, and the envelope to re-enforce the contact button 12 position in relation to the envelope. The bases and cement are then positioned intermediate the lamp and the contact button 12, and act to permanently insulate and re-enforce the position of the contact button 12. FIG. 5 shows a preferred embodiment of a completed double ended filament lamp having contact buttons 12 at each end. The base ends are shown in cross section to expose the cemented region.

Referring to FIG. 5, the lamp comprises a tubular envelope 30 of vitreous material such as quartz or glass and containing an energy translation means in the form of an axially disposed filament 22 of coiled tungsten wire. The filament 22 is supported by and electrically connected at each end to in leads having thin sealing foils 20. The intermediate foils 20 are hermetically sealed in a press seal portion at the ends of the envelope 30. When the envelope 30 is made of quartz, the sealing foil 20 and the outer lead rods 10 of the conductors 3 may be made of molybdenum, and the inner legs 26 of the conductors may be of tungsten. The envelope 30 may also contain a lamp fill of a rare gas such as argon and a small quantity of a halogen as is generally known in tungsten halogen lamp construction.

The lead rod 10 carries a contact button 12 which may consist of a cylindrical slug of nickel having an axial inset to receive the tip of the lead rod 10 in the rear face and welded to the lead rod 10 to form a metallurgical bond. The front or outer face 14 of the contact button 12 preferably has a concave spherical contour. The concave face serves as an electrical connection between the filament 22 and a socket, and as acts as a locating surface when used in a socket of proper design. Opposed probe like socket terminals having rounded ends may be biased toward each other to fit the concave faces 14 of the contact buttons and properly align the lamp in a fixture.

In an example lamp, a 500 watt double ended lamp was made. The contact button had a diameter of 4.67 millimeters (0.184 inches), and a thickness of 1.47 millimeters (0.058 inches). A molybdenum lead rod 0.635 millimeters (0.025 inches) in diameter was contact welded to the center of one side of the contact button, yielding a final rod length of 10.16 millimeters (0.40 inches). A sealing foil of 7.95 millimeters (0.313 inches) long was welded to the opposite end of the lead rod. A 55.7 millimeter (2.2 inch) coil between two 12.4 millimeter (0.48 inch) legs forming an 80.52 millimeters (3.170 inch) filament was attached to the opposite end of the sealing foil, and a second similar lead rod, contact button assembly as attached to the opposite end of the filament. The filament then had an overall length of 111.76 millimeters (4.4 inches).

The filament assembly was positioned in a quartz tube having a 9.92 millimeter (0.39 inch, T 3½) diameter. The contact buttons, and lead rods were held by flat surfaced claws, with the lead rod extending through claw slots. The filament assembly was stretched about five percent of the filament length, thereby setting the contact buttons firmly against the claw faces. The quartz tubing was then heated, and press sealed to seal the foils and quartz. The lamp was tubulated, and the enclosed volume around the filament was filled for tungsten halogen lamp operation, and finally sealed. Slotted ceramic cylinders were positioned around and intermediate the contact buttons and press sealed lamp ends, along with cement to finally finish the lamp structure. The disclosed operating conditions, dimensions, configurations and embodiments are as examples only, and other suitable configurations and relations may be used to implement the invention.

The improved method of attaching the contact on the outer lead of a double end lamp that eliminates several process steps and provides a superior contact to lead junction. The improved method provides a metallurgical bond between the outer lead rod and the contact button. The metallurgical bond eliminates the possibility of loose contacts and subsequent arcing, reduces the process steps in lamp assembly, reduces the cost of the contact (less material used and lower cost dies) and provides for a surer method of controlling contact button to contact distance. The improved method of assembly can be adapted to a variety of lamp types including high wattage or high current rating lamps by using larger moly rod in either round or rectangular form.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of forming a double ended filamentary lamp having press sealed ends, and button contacts comprising the steps of:

a) forming a filamentary assembly having a filament, by metallurgically bonding a button contact to a metal rod to form an end of the filamentary assembly, b) sealing the filamentary assembly in a tubular envelope by enclosing at least the filament in the tubular envelope, while leaving the button contact exposed for electrical connection, c) sealing a lamp fill in the enclosed lamp volume, and d) attaching supporting insulation intermediate the tubular envelope and exposed contact button.

2. A method of forming a double ended filamentary lamp having press sealed ends, and button contacts comprising the steps of:

a) forming a filamentary assembly having a filament, by metallurgically bonding a button contact to a metal rod forming an end of the filamentary subassembly, b) holding at least one end of the filament assembly in the region of the metal rod and button contact to accurately locate the button contact, c) sealing the filamentary assembly in a tubular envelope by enclosing at least the filament in the tubular envelope, while leaving the button contact exposed for electrical connection, d) sealing a lamp fill in the enclosed lamp volume, and e) attaching supporting insulation intermediate the tubular envelope and exposed contact button.

3. A method of forming a double ended filamentary lamp having press sealed ends, and button contacts comprising the steps of:

a) forming a contact button and lead rod subassembly by metallurgically bonding a button contact and a metal rod, b) forming a filament assembly by joining the button and rod subassembly to an end of a filament subassembly, c) holding the at least one end of the filament assembly in the region of the metal rod and button contact to accurately locate the button contact, d) sealing the filament assembly in a tubular envelope by enclosing at least the filament in the tubular envelope, while leaving the button contacts exposed for electrical connection, e) sealing a lamp fill in the enclosed lamp volume, f) attaching supporting insulation intermediate the tubular envelope and exposed contact button.

* * * * *